US007050597B2

(12) United States Patent
Akino

(10) Patent No.: US 7,050,597 B2
(45) Date of Patent: May 23, 2006

(54) DIRECTIONAL CAPACITOR MICROPHONE

(75) Inventor: Hiroshi Akino, Tokyo (JP)

(73) Assignee: Kabushiki Kaisha Audio_Technica, Tokyo (JP)

( * ) Notice: Subject to any disclaimer, the term of this patent is extended or adjusted under 35 U.S.C. 154(b) by 79 days.

(21) Appl. No.: 10/931,685

(22) Filed: Sep. 1, 2004

(65) Prior Publication Data

US 2005/0063557 A1 Mar. 24, 2005

(30) Foreign Application Priority Data

Sep. 19, 2003 (JP) ..... 2003-327735

(51) Int. Cl.
*H04R 25/00* (2006.01)

(52) U.S. Cl. ..... 381/356; 381/174; 381/369

(58) Field of Classification Search ..... 381/355–359, 381/361–363, 368–369, 174, 191
See application file for complete search history.

(56) References Cited

U.S. PATENT DOCUMENTS 5,703,957 A * 12/1997 McAteer ..... 381/356
5,878,147 A * 3/1999 Killion et al. ..... 381/356
6,567,526 B1 * 5/2003 Killion et al. ..... 381/356
6,757,399 B1 * 6/2004 Cheng ..... 381/356

* cited by examiner

*Primary Examiner*—Suhan Ni
(74) *Attorney, Agent, or Firm*—Welsh & Katz, Ltd.

(57) ABSTRACT

It is a primary object of the present invention to suppress the variability of an acoustic resistance of sound passing from a rear acoustic terminal to the back surface of a vibration plate by sufficiently obtaining the contact area between an acoustic resistor and its storage portion even in a capacitor microphone having a small diameter.

In order to achieve the object, as shown in FIG. 3, a support 140 of a fixed electrode 130 is formed as an electrically conductive column including a large and a small diameter-columns with the both columns disposed concentrically. The difference between each of the inner diameters of the large and the small diameter-columns is increased as possible as it can so that the contact area between the acoustic resistor 151 housed in the large diameter-column 141 and the bottom 141*a* of the large diameter-column can be increased. Therefore, the variability of the acoustic resistance can be suppressed.

5 Claims, 3 Drawing Sheets

DIRECTIONAL CAPACITOR MICROPHONE

FIELD OF THE INVENTION

This invention relates to a directional capacitor microphone and, more particularly, this invention relates to a capacitor microphone structure for arrangement of an acoustic resistor for developing the directional capacitor microphone having a small diameter.

BACKGROUND OF THE INVENTION

A directional sound pressure gradient microphone includes a front acoustic terminal for leading a sound wave from a sound source to the front and the back surfaces of a vibration plate and a rear acoustic terminal. An acoustic resistor is mounted in an acoustic path from the rear acoustic terminal to the back surface of the vibration plate for generating a predetermined sound propagation-delay time.

A typical directional microphone of a prior art will be described referring to FIGS. 6*a* and 6*b*. FIG. 6*a* is a front view illustrated from the side of a front acoustic terminal of the directional microphone. FIG. 6*b* is a sectional view of FIG. 6*a* taken along the line A—A.

According to FIGS. 6*a* and 6*b*, the microphone includes a columned microphone case 10 made of aluminum or the like. The front face of the microphone case includes a predetermined number of a front acoustic terminal 11 which has an opening. The front acoustic terminal 11 generally has a metallic mesh.

The microphone case 10 includes a vibration plate 12 strained and supported by a support ring (diaphragm ring) 12, and a fixed electrode 13 supported by an insulating pedestal 13*a*. The vibration plate 12 and the fixed electrode 13 are faced and disposed through a spacer 12*b* with a predetermined gap obtained between the plate 12 and the electrode 13. An electret is generally put on the fixed electrode in a small capacitor microphone.

The insulating pedestal 13*a* is called "cylinder" and is a disc-formed molded component made of synthetic resin fitted in the microphone case 10. The rear face of the insulating pedestal 13*a* has a rear acoustic terminal 14. The pedestal has a plurality of acoustic paths 15 leading a sound wave from the rear acoustic terminal 14 to the back face of the vibration plate 12. For example, each of the paths 15 is coaxially arranged and equally spaced apart.

A recess 16 which communicates with each of the acoustic paths 15 and which has a much larger diameter than that of each of the paths 15 is disc-formed at the side of the support of the fixed electrode in the insulating pedestal. The acoustic resistor 17 made of a nylon mesh or the like as well as a damper 18 are housed in the recess 16. The damper 18 is an elastic body such as sponge having air permeability and is used for pressing the acoustic resistor 17 to the bottom of the recess 16.

A circuit substrate 20 having an impedance converter 21, for which a FET (Field Effect Transistor) is used in this example, is disposed at the rear face side of the insulating pedestal 13*a*. The pedestal as well as the circuit substrate are fixed by caulking an opening end of the microphone case 10.

A contact terminal 23 is disposed in the center portion of the insulating pedestal 13*a* for electrically connecting the fixed electrode 13 to the FET 21. In this example, a contact spring 24 is mounted between the contact terminal 23 and the fixed electrode 13. The FET 21 is disposed on the circuit substrate 20 through a support cushion 22. The elastic contact of the contact terminal 23 to the gate of the FET 21 obtains high reliability of the connection.

In the capacitor microphone having a structure described above, the acoustic resistor 17 directly affects the directional frequency response, the gain and the signal-to-noise ratio Therefore, it is very important that the variability of the acoustic resistance in the acoustic resistor 17 is designed to be as small as possible.

The variability of the acoustic resistance is mainly generated by sound leakage from the gap between the acoustic resistor 17 and the recess 16 housing the resistor. That is, the variability of the acoustic resistance occurs by the sound which avoids the acoustic resistor 17 and which propagates from the bottom to the side of the recess 16 and which passes to the rear surface of the vibration plate 12.

To solve the problem, the variability of the acoustic resistance is suppressed by sufficiently increasing the inner diameter of the recess 16 and the contact area between the recess and the acoustic resistor 17. However, for example, in a capacitor microphone having a diameter of a little over 10 mm, the recess 16 housing the acoustic resistor 17 becomes small in proportion to the diameter of the microphone and a sufficiently large contact area of the acoustic resistor 17 and the recess cannot be obtained. Therefore, the variability of the acoustic resistance generates the variability in the directional frequency response, the gain and the signal-to-noise ratio.

SUMMARY OF THE INVENTION

It is a primary object of the present invention to suppress the variability of an acoustic resistance against sound passing from a rear acoustic terminal to the back surface of a vibration plate by obtaining a sufficiently large contact area between an acoustic resistor and its storage portion even in a capacitor microphone having a small diameter.

It is another object of the invention to decrease the number of the components for electrically connecting between a fixed electrode and an impedance converter in a directional capacitor microphone and to increase reliability in the electric connection.

In order to realize the above objects, a directional capacitor microphone of the invention includes a microphone case having a front and a rear acoustic terminals. A vibration plate is disposed at the side of the front acoustic terminal in the microphone case with the vibration plate strained on a support ring, and a fixed electrode is supported by a support at the side of the rear acoustic terminal in the microphone case with the fixed electrode facing to the vibration plate. An acoustic resistor is mounted in an acoustic path from the rear acoustic terminal to the back surface of the vibration plate, and a lead is provided for connecting the fixed electrode to the impedance converter. The directional capacitor microphone is characterized in that the support is an electrically conductive column including a large diameter-column which can support the fringe portion of the fixed electrode and a small diameter-column which has a smaller diameter than that of the large diameter-column with the small diameter-column concentrically communicating with the rear end of the large diameter-column, and that the small diameter-column has a sound inlet communicating with the rear acoustic terminal, and that the acoustic path is formed with the small and the large diameter-columns, and that the acoustic resistor is housed in the large diameter-column, and the small diameter-column is so formed as to electrically contact the impedance converter as the lead.

This invention includes not only an aspect that the support is a metallic cutting product but also an aspect that the support is a molded component of synthetic resign having a metal plated film on its surfaces. It is preferable that the support is housed with the support covered with an insulating sleeve since the support is electrically conductive.

The invention includes an aspect that the rear end of the small diameter-column is closed as an electric contact of the impedance converter.

The structure described above enables to separate the microphone case into a capacitor capsule and a case body. The capacitor capsule includes the vibration plate, the fixed electrode and the support and the case body includes the impedance converter and a microphone cable.

According to this invention, the support of the fixed electrode is formed as the electrically conductive column including the large and the small diameter-columns with the both columns concentrically disposed. The support itself is used as the lead of the fixed electrode to the impedance converter. The acoustic resistor is housed in the large diameter-column and the lead is concentrically arranged to the acoustic resistor so that the sufficiently large contact area between the acoustic resistor and the housing portion is obtained even in the capacitor microphone having a small diameter. Therefore, the variability of the acoustic resistance of sound passing from the rear acoustic terminal to the back surface of the vibration plate can be suppressed minimum.

DETAILED DESCRIPTION OF THE PREFERRED EMBODIMENTS

Figure 1:
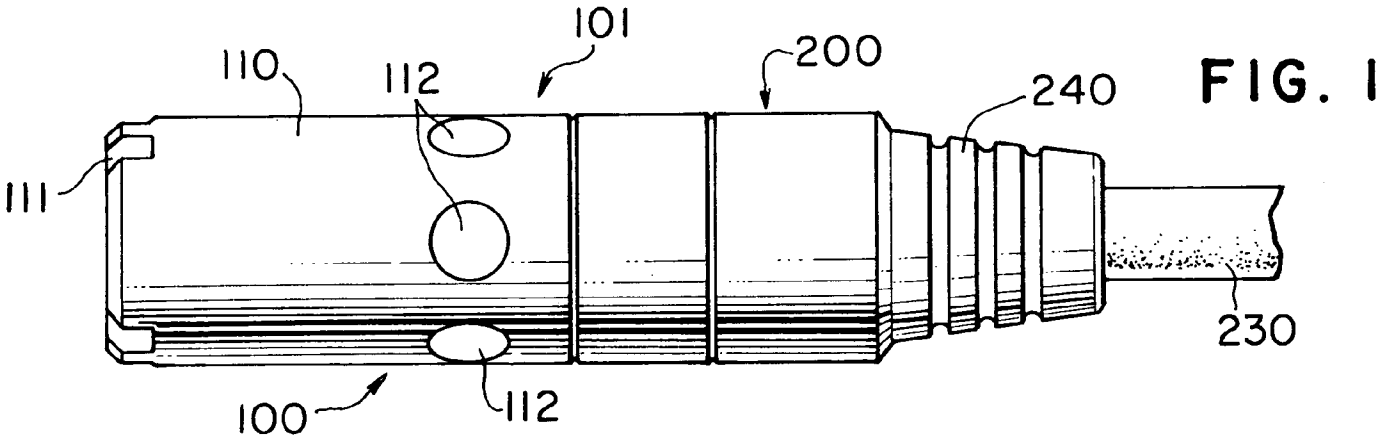
FIG. 1 is an outline side view of a directional capacitor microphone in the present invention.
Figure 2:
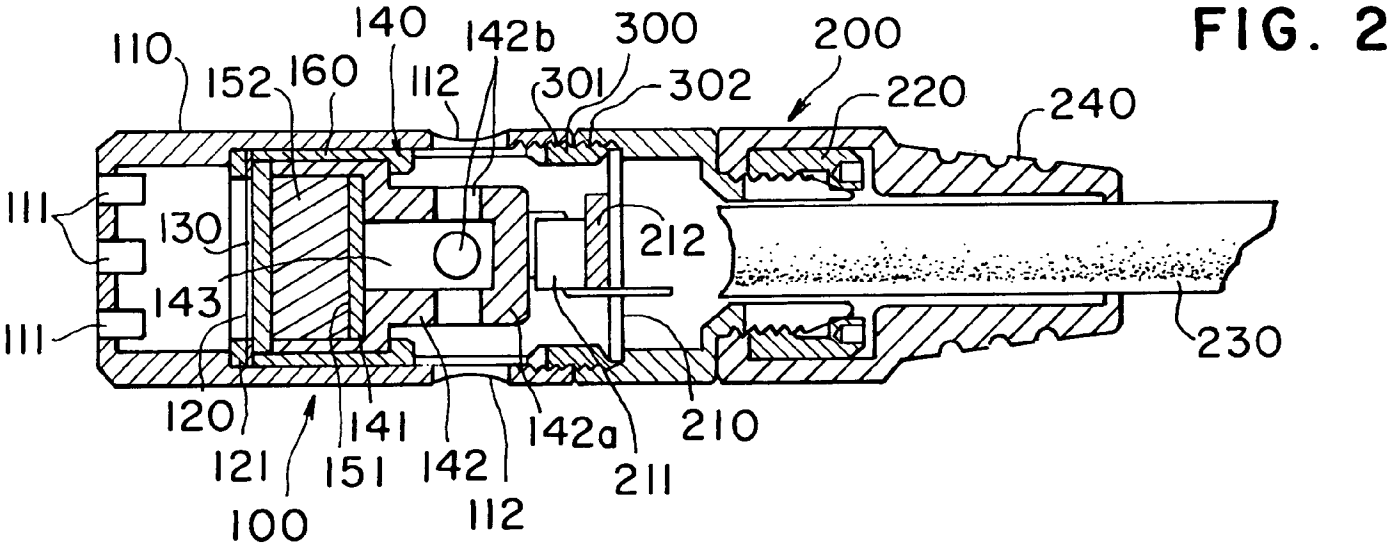
FIG. 2 is a longitudinal sectional view of the directional capacitor microphone in the invention.
Figure 3:
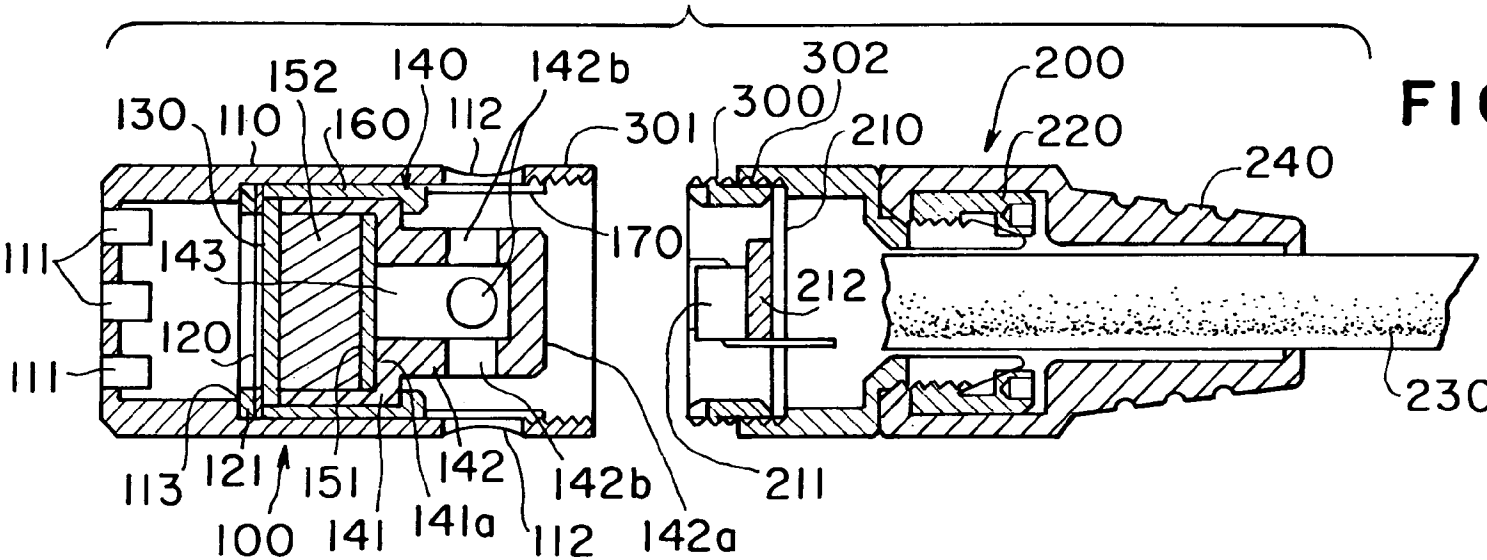
FIG. 3 is an exploded sectional view of the directional capacitor microphone in the invention.
Figure 4:
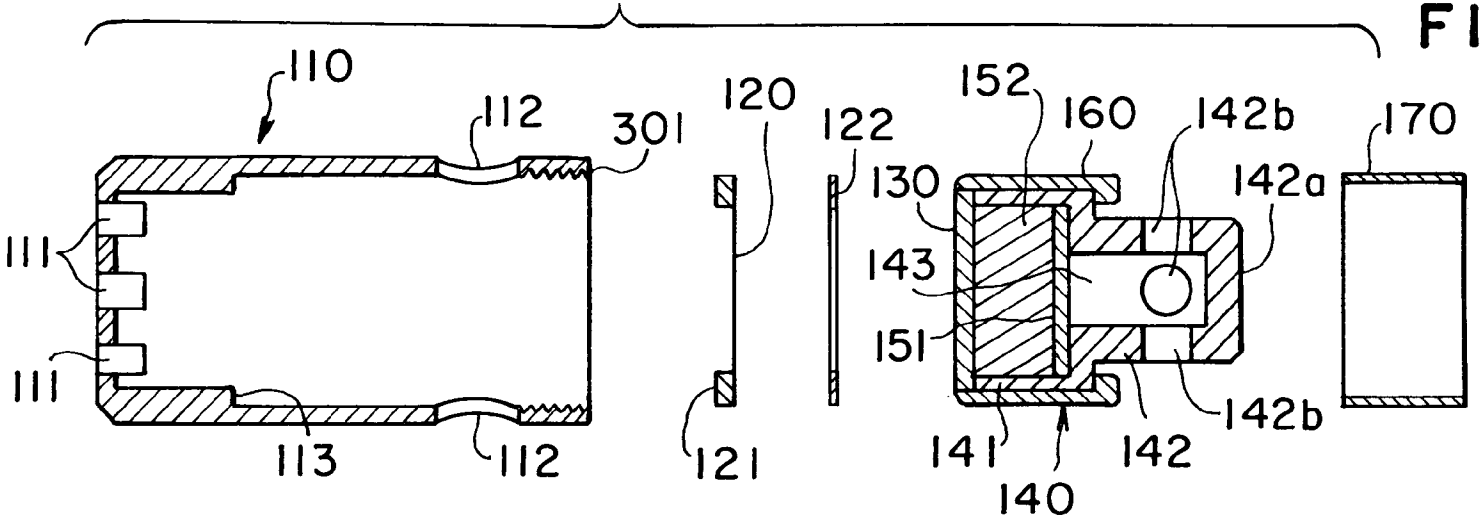
FIG. 4 is a main partial exploded sectional view of the directional capacitor microphone in the invention.
Figure 5:
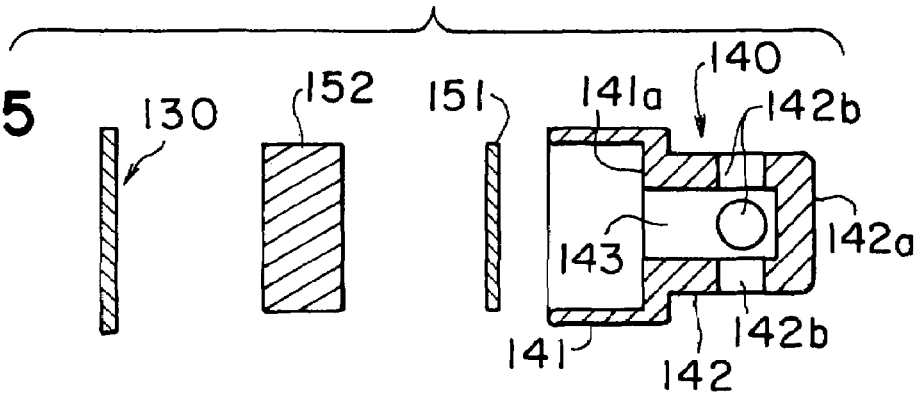
FIG. 5 another main partial exploded sectional view of the directional capacitor microphone in the invention.
Figure 6A:
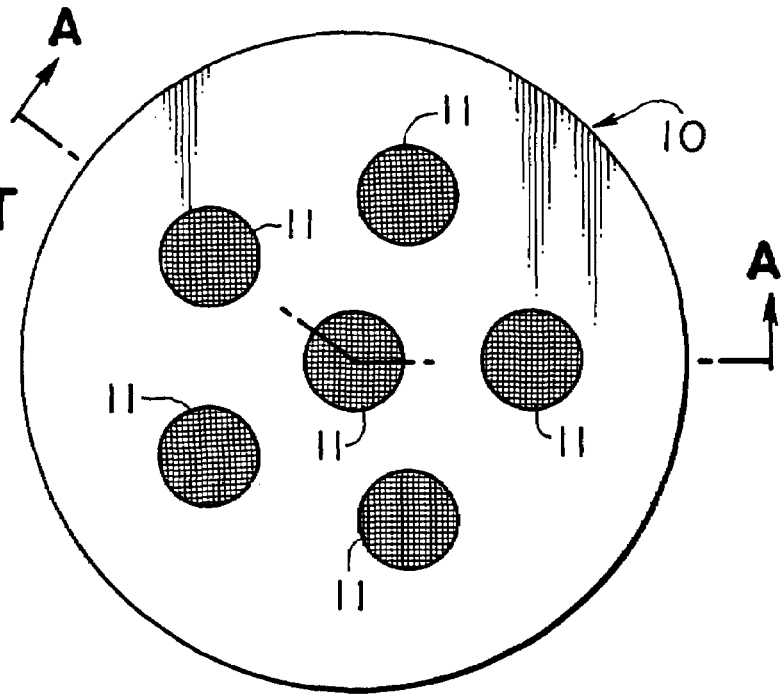
FIG. 6a PRIOR ART
FIG. 6*a* is a front view of a directional capacitor microphone of a prior art.
Figure 6B:
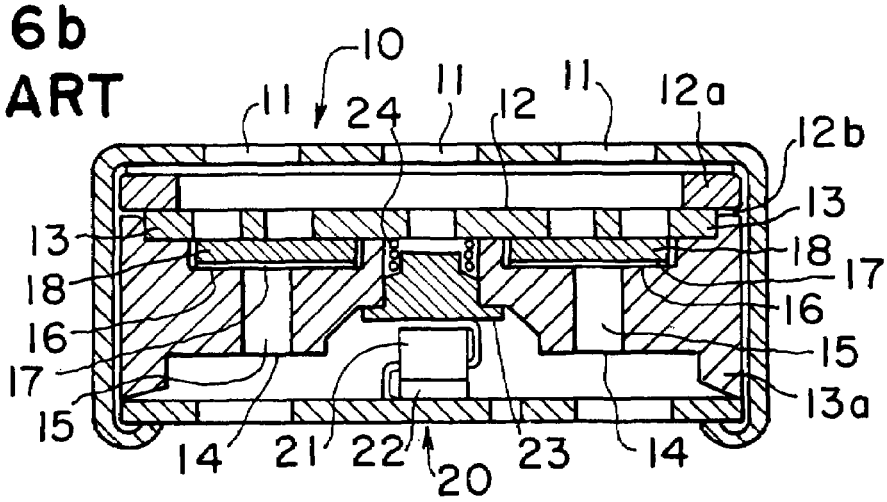
FIG. 6b PRIOR ART
FIG. 6*b* is a sectional view of FIG. 6*a* taken along the line A—A.

Referring to FIG. 1 to FIG. 5, some embodiments will be described, however, the present invention is not restricted to these embodiments. FIGS. 1, 2 and 3 are, respectively, an outline side view, a longitudinal sectional view and an exploded sectional view of a directional capacitor microphone in the invention. FIGS. 4 and 5 are main partial exploded sectional views of the directional capacitor microphone in the invention.

As shown in FIGS. 1 and 2, a microphone case 101 of the directional capacitor microphone includes a capacitor capsule 100 and a case body 200. In this example, the capacitor capsule 100 and the case body 200 are connected and released through a joint ring with male screw threads 300 as shown in FIG. 3.

The capacitor capsule 100 has a columned capsule case 110 made of metal such as brass. A front acoustic terminal 111 is disposed in the front face of the capsule case 110 and a rear acoustic terminal 112 is formed in the circumference of the rear end in the capsule case 110. In this example, the front acoustic terminal 111 is a slit-shaped opening and the rear acoustic terminal 112 is a round hole disposed with each of the holes equally spacing circumferentially apart.

The case body 200 includes a column made of metal such as brass and houses a circuit substrate 210 having an impedance converter such as a FET (Field Effect Transistor) 211. The FET 211 is supported on the circuit substrate 210 through a support cushion 212 having an elastic rubber body. A microphone cable 230 is fixed by a cable clamp 220 having a screw ring at the rear end of the case body 200. The microphone cable 230 is connected to the source and the drain of the FET 211, which is not shown.

At the rear end of the case body 200 is mounted a cable bush 240 made of rubber covering the cable clamp 220 and the neck of the microphone cable 230. The inner circumference of the rear opening in the capsule case 110 includes a female screw 301 screwed together with the joint ring with male screw threads 300. The inner circumference of the front opening in the case body 200 includes a female screw 302 screwed together with the joint ring with male screw threads 300.

Referring to FIGS. 4 and 5, a vibration plate 120, a spacer 122, a fixed electrode 130 and a support 140 are inserted in sequence to the inside of the capsule case 110 from the rear opening thereof, and finally, a side mesh 170 for the rear acoustic terminal 112 is mounted. The side mesh 170 is the mesh for preventing dust or foreign substances from entering to the capsule case and has no function for an acoustic resistor.

The vibration plate (diaphragm) 120 uses a synthetic resin thin film having a thickness of approximate 1.2 μm. For example, the thin film is gold-vacuum evaporated in the fixed electrode-side of the film. The vibration plate 120 is supported by a support ring (diaphragm ring) 121 made of brass or the like with a predetermined tension given to the plate 120 and is housed in the capsule case 110. A step 113 is so formed as to position the support ring 121 in the capsule case 110.

The fixed electrode 130, for example, uses an electret board that is an aluminum plate having a thickness of approximate 0.3 mm on which an electret member of FEP or the like having a thickness of approximate 25 μm is put. The electret board is preferably used in the point that the board which has a function of self-polarizability needs no other power source for polarization. However, the fixed electrode 130 can use a metallic plate which needs the power source for polarization. The electrode 130 has a predetermined number of holes penetrating from the front surface to the back surface of the electrode.

In this invention the support 140 is a column which includes a large diameter-column supporting the fringe portion of the fixed electrode 130 and a small diameter-column having a smaller diameter than that of the larger diameter-column. The large and the small diameter-columns communicate with the small diameter-column concentrically disposed to the rear of the large diameter-column. In this example, the support 140 is a metallic cut product of brass, however, the support can use a molded component of synthetic resin having a metal plated film on the surfaces thereof.

An acoustic resistor 151 as well as a damper 152 are housed in the large diameter-column. The resistor 151 uses a fine textile mesh (for example, Nylon Mesh #508 of NBC Industry Corporation). The damper 152 is used for pressing and fixing the acoustic resistor 151 on the bottom 141*a* of the large diameter-column 141. For example, the damper uses air-permeable sponge having the compression ratio 1 to 5 of Product No. HR 50 of Bridgestone Corporation.

The small diameter-column 142 has an enough length to contact to the gate of the FET 211 when the capacitor capsule 100 and the case body 200 are connected as shown in FIG. 2. It is preferable that a rear end 142*a* of the small diameter-column 142 is closed as a flat contact suitably contacting to the gate of the FET 211.

The large and the small diameter-columns 141, 142 communicate. The small diameter-column 142 has a plurality of sound inlets 142*b* through which sound from the rear acoustic terminal 112 enters. It is preferable that each of the sound inlets 142*b* is disposed at the position facing to that of the rear acoustic terminal 112.

Therefore, the sound passes from the rear acoustic terminal 112 to the small diameter-column 142, and then the sound is introduced to the back surface of the vibration plate 120 through an acoustic path 143, the large diameter-column 141 and the penetrating holes (not shown) of the fixed electrode 130. On the way to the vibration plate, the sound is acoustically resisted by the acoustic resistor 151.

Sound leakage, which is the a sound flow that reaches the back surface of the vibration plate with the sound avoiding the acoustic resistor 151, is mainly generated by the sound passing from the bottom 141*a* of the large diameter-column 141 to the radial direction of the column 141. According to the invention, since the large and the small diameter-columns 141, 142 are concentrically disposed, even in a microphone having a small diameter. The contact area between the bottom 141*a* of the large diameter-column 141 and the acoustic resistor 151 can be increased by increasing the area of the bottom 141*a*.

The bottom 141*a* of the large diameter-column 141 is a step face regulated by the difference between the inner diameters of the large and the small diameter-columns. Therefore, the inner diameter of the large diameter-column is designed to be as large as possible, on the other hand, the inner diameter of the small diameter-column is designed to be as small as possible. Accordingly, the sufficiently large contact area between the bottom 141*a* of the large diameter-column and the acoustic resistor 151 can be obtained.

Accordingly, the variability of the acoustic resistance against the sound from the rear acoustic terminal 112 to the back surface of the vibration plate 120 is decreased. The small diameter directional capacitor microphone having the small variability in the directional frequency response, the gain and the signal-to-noise ratio is provided.

Further, according to the invention, the support 140 itself can be used as the lead of the fixed electrode 130 so that no insulating pedestal made of synthetic resin of the prior art needs and smaller directional capacitor microphone is provide. No molding die needs, so that low cost for producing the microphones is realized.

The capsule case 110 and the support 140 are electrically conductive so that the support 140 is housed with the support covered with an insulating sleeve 160. In this invention, the insulating sleeve 160 can use not only a molded sleeve but also an insulating tube. As an actual assembling process, it is preferable that after the fixed electrode 130 and the support 140 are integrally assembled, the assembly of the electrode and the support are housed in the capsule case 110.

According to this invention, in the field of the directional capacitor microphone a small variability of the directional frequency response, the gain and the signal-to-noise ratio generated by the variability of the acoustic resistance is decreased and a high performance directional capacitor microphone having a small diameter is provided. The invention can contribute to use in industry.

The invention claimed is:

1. A directional capacitor microphone including a microphone case having a front and a rear acoustic terminals and a vibration plate disposed at the side of the front acoustic terminal in the microphone case with the vibration plate strained on a support ring, the directional capacitor microphone further including a fixed electrode disposed at the side of the rear acoustic terminal in the microphone case and supported by a support with the fixed electrode facing to the vibration plate, the directional capacitor microphone further including an acoustic resistor mounted in an acoustic path from the rear acoustic terminal to the back surface of the vibration plate and a lead for connecting the fixed electrode to an impedance converter, the directional capacitor microphone comprising:

a large diameter-column being able to support the fringe of the fixed electrode;

a small diameter-column having a smaller diameter than that of the large diameter-column and communicating to the rear end of the large diameter-column with the both columns concentrically disposed, said small diameter-column including, one or more sound inlets, wherein said small diameter-column is so formed as to electrically contact to the impedance converter as a lead;

an acoustic path formed with the small and the large diameter-columns;

an acoustic resistor housed in the large diameter-column; and wherein the support is an electrically conductive column.

2. A directional capacitor microphone according to claim 1, wherein the support is a metal cut product or a molded component of synthetic resign having a metal plated film on the surfaces of the support.

3. A directional capacitor microphone according to claim 1, wherein the support is housed in the microphone case with the support covered with an insulating sleeve.

4. A directional capacitor microphone according to claim 1, wherein the small diameter-column has a rear end closed as an electric contact of the impedance converter.

5. A directional capacitor microphone according to claim 1, wherein the microphone case can be separated to a capacitor capsule and a case body, the capacitor capsule including the vibration plate, the fixed electrode and the support, the case body including the impedance converter and a microphone cable.

* * * * *